US006155245A

United States Patent [19]

Zanzuri

[11] Patent Number: 6,155,245

[45] Date of Patent: Dec. 5, 2000

[54] FLUID JET CUTTING SYSTEM AND METHOD

[76] Inventor: Clement Zanzuri, 6800 SW. 81 Ter., Miami, Fla. 33143

[21] Appl. No.: 09/298,897

[22] Filed: Apr. 26, 1999

[51] Int. Cl.[7] ..... B28D 1/10

[52] U.S. Cl. ..... 125/12; 83/53; 83/177; 125/1; 125/38; 451/2; 451/38

[58] Field of Search ..... 83/53, 177; 125/1, 125/12, 38; 451/2, 3, 38, 39, 40, 87

[56] References Cited

U.S. PATENT DOCUMENTS

| | | | |
|---|---|---|---|
| 3,521,407 | 7/1970 | Nalley et al. | 451/2 |
| 3,691,695 | 9/1972 | Green et al. | 451/2 |
| 3,978,748 | 9/1976 | Leslie et al. | 83/177 |
| 4,594,924 | 6/1986 | Windisch | 83/177 |
| 4,614,100 | 9/1986 | Green et al. | 451/2 X |
| 5,117,366 | 5/1992 | Stong | 451/2 X |
| 5,782,673 | 7/1998 | Warehime | 451/2 |

FOREIGN PATENT DOCUMENTS

| | | | |
|---|---|---|---|
| 0522932A1 | 1/1993 | European Pat. Off. | 451/2 |

*Primary Examiner*—Timothy V. Eley
*Attorney, Agent, or Firm*—Malloy & Malloy, P.A.

[57] ABSTRACT

A fluid jet cutting system structured to make desired quality cuts in a solid material such as stone, granite, steel and/or marble, the system having a positioning assembly which positions the solid material in a cuttable orientation over a fluid reservoir and at least one fluid jet generator which directs a concentrated, high pressure stream of fluid through a nozzle at the solid material such that the solid material is cut by the high pressure stream of fluid. The fluid jet generator further includes a guidance system which passes the nozzle over the solid material in a predetermined cutting path and at a predetermined movement rate such that the high pressure stream of fluid engages and cuts through the solid material in accordance with the cutting path. A quality monitoring assembly monitors variations in flow conditions of the high pressure stream of fluid as it enters the fluid reservoir and modifies the movement rate of the high pressure stream of fluid in response to the monitored conditions until optimal conditions are detected and a substantially consistent quality cut of the solid material is ensured.

16 Claims, 2 Drawing Sheets

FLUID JET CUTTING SYSTEM AND METHOD

BACKGROUND OF THE INVENTION

1. Field of the Invention

The present invention relates to a fluid jet cutting system and method structured to maximize the cutting rate that can be achieved when cutting solid materials, such as stone type materials, without sacrificing the necessary precision and finish quality associated with the fluid cutting process, the system and method providing an effective and accurate determinant of cut quality which does not interfere with and/or hinder the normal cutting process and which provides a substantially continuous indication of cut quality as the cuts are being made, thereby permitting maximization of the movement rate that can achieve the desired quality.

2. Description of the Related Art

In a variety of industries wherein a solid material must be cut in a very detailed, precise, and often intricate pattern, the necessary cuts are often made by directing a high power, high pressure stream of fluid, preferably water with an abrasive additive such as garnet, into the surface of the solid material so as to achieve the appropriate cut. Naturally, many variables can come into play when making such a high precision fluid cut, and accordingly, conventional systems, while automated to a certain extent, still require a great degree of monitoring and estimation by an individual operator to ensure that a desired precision and quality cut is achieved and maintained through the entire cutting process of a particular solid material, and to ensure that malfunctions in the cutting process do not occur.

As can be appreciated, the solid materials, frequently stone, marble, granite, steel and other metals can tend to be rather expensive. As a result, many factors need to be considered to ensure that precision and a desired quality cut is maintained at all times throughout a particular cut, and such that an improper cut or degradation in quality in the middle of a cutting pattern will not result, thereby ruining an entire, elaborate item being cut. In particular, when cutting a solid material a variety of cutting grades are typically available depending upon the intended needs and use of the article being cut. For example, in elaborate and decorative inlay systems or for perimeter cuts, a certain higher degree of quality is desired to ensure that components fit together properly. Conversely, in some other applications a more rough, lower quality cut is all that is needed. Naturally, it is important to make sure that at least the minimum desired quality is maintained, however, cutting to excessive quality than what is needed does not add any benefit and merely increases the time it takes to complete the cut, the operating time of the machinery and the wear and tear on the machinery. Still, however, as the most important consideration is to ensure that at least the minimum quality is achieved, operators must err on the side of caution so as to avoid wasting the solid material, even if this means a longer, slower cutting process than is necessary.

Indeed, even with many increases in technology, the optimal movement or cutting rate to be utilized for a particular type of material and a particular quality cut is at best imprecise. Specifically, presently available charts and lists only provide general guidelines for the desired cutting rate to be used for a selected cut quality. These values are, however, only guidelines that can vary greatly depending on a variety of factors present within the cutting process. For example, the type of cut, the type of material and even the quality of certain portions of a single slab or of different batches of the same material can vary, thereby altering the quality that is achieved throughout the cutting process using only those general guidelines. As such, there remains a need for a system and method which precisely ensures the desired cut quality.

In addition to the difficulties associated with maintaining a precise, desired cut quality at all times throughout a particular cut, a further drawback associated with present fluid cutting technologies relates to the need for constant monitoring of the system. In particular, the nozzles utilized in such systems often have a limited life, and based upon the precision and close proximity between the nozzle and the solid material, malfunctions can sometimes occur which interfere with or interrupt the cutting process. When such a malfunction occurs, the cut quality is either very poor so as to ruin the material, or more commonly, the fluid stream does not actually penetrate and cut through the solid material, thereby resulting in potential damage to the material and to the machinery, and resulting in excessive waste of raw materials and machine operating life. Accordingly, a great deal of monitoring and observation of the entire cutting process by employees and supervisors must generally be maintained at all times with existing systems. This can be a significant limitation if full automation of a facility is required, as unsupervised operation of the system is typically not acceptable since continued operation of the system after a severe malfunction can have devastating consequences.

For the preceding reasons, it would be highly beneficial to provide a system and method which continuously functions to ensure that a cut of a desired quality is being made, thereby maximizing the cutting rate that can be achieved by eliminating the requirement to move overly slowly causing a quality higher than need to be achieved. It would also be beneficial to provide a system that can allow extended and substantially continuous cutting operation of fluid jet cutting devices, thereby increasing the volume of solid materials which can be properly cut and shaped within a given time period. Further, such a system should preferably be substantially precise and free from malfunction, without requiring constant manual operation and/or manual observation should a malfunction occur. Another important feature that would be beneficial is to provide such an improved system for use in conjunction with existing cutting devices, as the cutting devices themselves can tend to be rather expensive, and replacement and/or re-tooling is not typically practical, even if the capacity of the machine can be significantly increased. As such, an improved system should work with little and/or minor modification to existing cutting systems, while still providing the necessary precision for substantially full automation.

SUMMARY OF THE INVENTION

The present invention is directed towards a fluid jet cutting system. In particular, the fluid jet cutting system is structured to make precision cuts of a desired quality in a solid material, such as stone, granite, metal or marble, thereby helping to define a precise shape or pattern within the solid material in an efficient and effective manner.

The preferred cutting system of the present invention includes a positioning assembly. The positioning assembly is structured to position the solid material, typically in a large sheet, slab or block form, in a cuttable orientation. Further, the fluid jet cutting system includes at least one fluid jet generator. The fluid jet generator includes at least one nozzle and is structured to direct a concentrated, high pressure stream of fluid through the nozzle and towards the solid material. In this regard, the fluid jet generator also includes a guidance system. The guidance system is structured to pass the nozzle over the solid material in a predetermined cutting path and at a predetermined movement rate, with the high pressure stream of fluid being directed from the nozzle. As a result, the high pressure stream of fluid will pass through the nozzle and engage and cut through the solid material in accordance with that precisely defined cutting path followed by the nozzle.

Preferably disposed beneath the solid material that is being cut, the present invention further includes a fluid reservoir. In particular, the fluid reservoir is disposed to receive the high pressure stream of fluid subsequent to its passage through the solid material during the cutting thereof. Moreover, disposed to monitor variations in the high pressure stream of fluid entering the fluid reservoir, the present invention includes a quality monitoring assembly. Specifically, the quality monitoring assembly monitors and identifies any variations in the high pressure stream as it enters the fluid reservoir, and modifies the movement rate of the high pressure stream of fluid over the solid material in response to those detected variations. As a result, a substantially consistent, precise cut of the solid material at a desired quality can be achieved as any deviation from a desired cutting quality are immediately identified through variations in the detected characteristics of the fluid stream, and are compensated for until the detected characteristics of the fluid stream are within desired parameters.

The fluid jet cutting system is also preferably part of a method of making a precision cut, of a desired quality, in a solid material. The method includes an initial step of positioning the solid material in a particular cuttable orientation over a fluid reservoir. Subsequently, a high pressure stream of fluid is directed into the solid material so as to cut through the material. This high pressure stream is also moved along a specific, predefined cutting path, and at a specific, adjustable movement rate.

The flow conditions of the high pressure stream are monitored as the high pressure stream passes through the solid material and enters the fluid reservoir. Finally, the movement rate of the high pressure stream is adjusted in response to the monitored flow conditions of the fluid stream until optimal flow conditions that indicate a cut of a desired quality is being achieved at a maximum cutting rate possible.

An object of the present invention is to provide a fluid jet cutting system which can significantly increase the rate at which an effective precision cut is made within a solid material, but which also does not sacrifice the quality requirements and precision of that cut.

A further object of the present invention is to provide a precision fluid jet cutting system which does not require extensive manual monitoring and/or modification of the cut precision, but is structured to generally maintain an optimal, precise cut of a desired quality at all times throughout the cutting process.

Another object of the present invention is to provide a fluid jet cutting system which can utilize existing fluid jet cutting devices so as to provide an automated and much more precise cutting system which maximizes the acceptable cutting rates that can be utilized to still generate an effective precision cut of a desired quality.

Still another object of the present invention is to provide a fluid jet cutting system which can be continuously monitored and regulated to ensure that a precision cut within desired quality parameters is maintained throughout an entire cutting pattern, even if variations in the dimensions and/or quality of the material are encountered along the cutting path.

Also an object of the present invention is to provide a fluid jet cutting system which is capable of independently identifying a cutting failure and shutting down the system in response thereto, thereby permitting fully automated cutting to be performed.

A further object of the present invention is to provide a fluid jet cutting system which ensures that a cut is within desired quality parameters regardless of the type of material and/or variations in the cutting process such as wear and tear on the nozzle, straight versus curved cutting, and/or abrasive additive quality or quantity.

An added object of the present invention is to provide a method of making a precision cut in a solid material which can allow continuous operation of a fluid jet cutting system while ensuring that a precise and accurate cut within desired quality parameters is achieved throughout.

These and other objects will become readily apparent with the following claims and the accompanying detailed description.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying Figures, the present invention is directed towards a fluid jet cutting system, generally indicated as 10. In particular, the fluid jet cutting system 10 is structured to make precision cuts in a solid material 5. The solid material 5 can include a variety of different materials, including wood, glass, and plastic, but preferably includes a stone type material such as marble, granite, etc, or a metallic material, such as steel or iron. Furthermore, large, typically expensive slabs or blocks of the solid material are typically utilized in the cutting process, with very specifically defined and precise cuts being formed therein in order to define a finished product.

Figure 1:
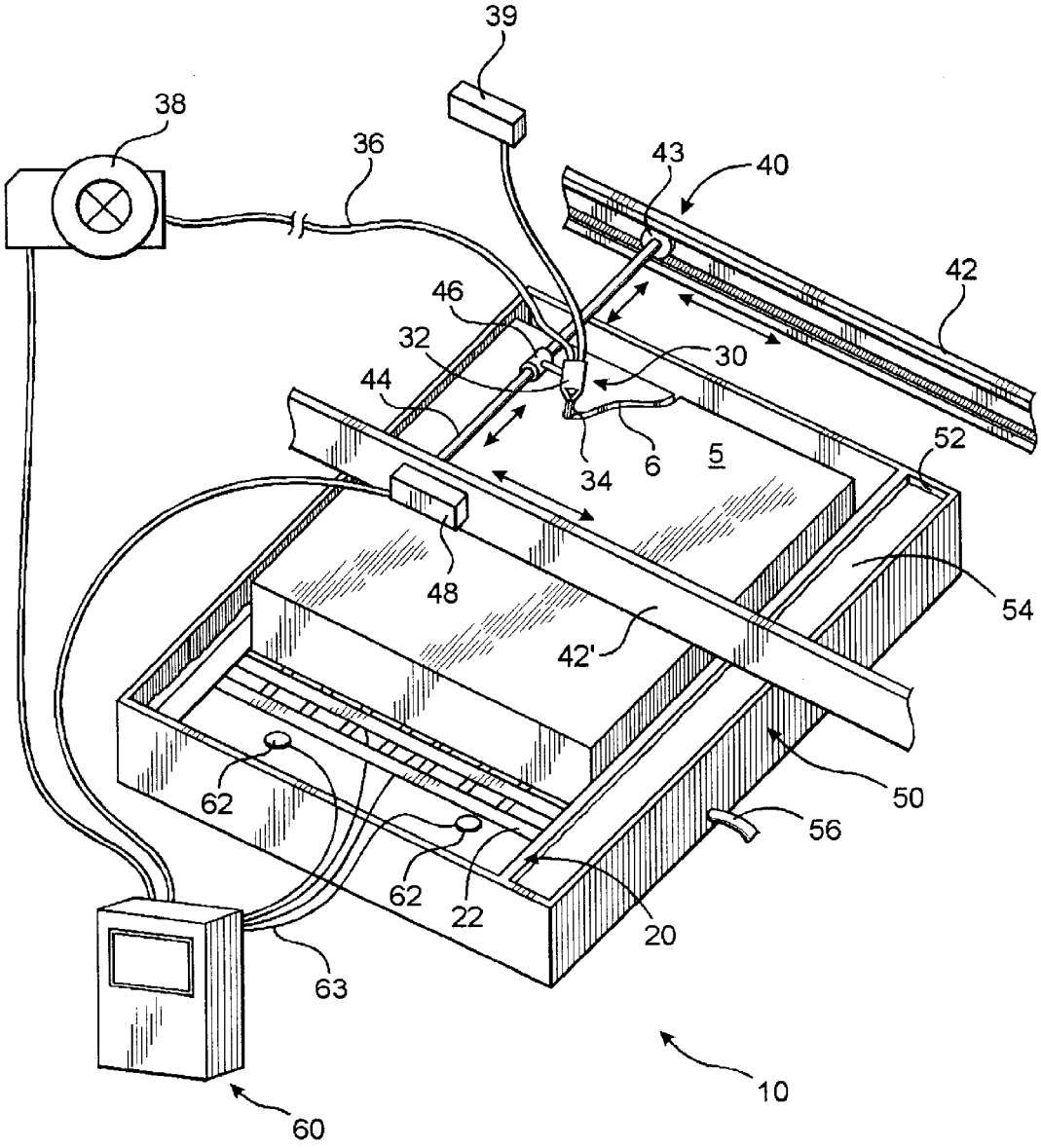
FIG. 1 is a perspective representation of a preferred fluid jet cutting system of the present invention.
Figure 2:
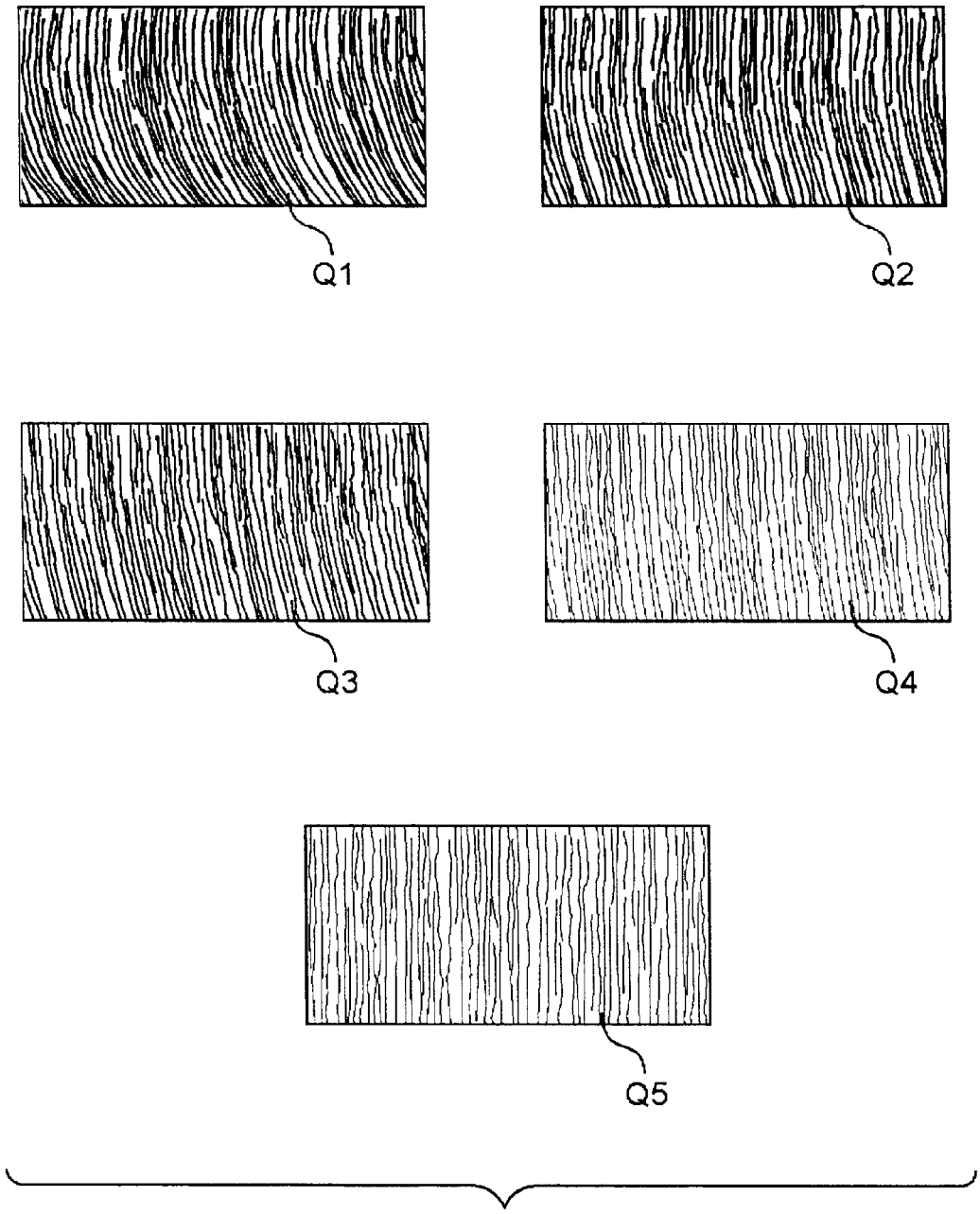
FIG. 2 is an illustration of variations in cutting quality.

Naturally, when making the precision cuts in the solid material 5, the quality of the cut is a critical characteristic. Still, however, as increasing the quality typically means slowing down the cutting process, excessively high quality is also not desirable as it results in added down time of the machine, wear on the nozzle, and use of raw materials. In particular, depending upon the needs of the user, the quality requirements may vary from a very high quality cut Q5, to an intermediate quality cut Q3, or a lower quality, separation cut Q1, as illustrated in FIG. 2. For example, if all that is required is that a portion of the solid material 5 be separated for another future use, a low quality Q1 or Q2 cut is all that is desired, and any increase in quality is not necessary and would merely increase the wear and down time on the cutting system 10. Moreover, when fitting a variety of interlocking segments for the formation of an elaborate design wherein a certain degree of quality is desired, such as a Q3 or Q4 quality, and any lesser quality could result in an improper fit between pieces so as to require additional grinding, while any higher quality would result in the added down time and wear on the machine. Lastly, if a very high quality Q5 cut is desired, as is typically the case with end cuts and very expensive materials, any decrease in cut quality below the required parameter could result in a loss of materials. Accordingly, it is very critical to ensure that a precision cut within desired quality parameters is truly achieved and maintained.

Looking to the fluid jet cutting system 10 of the present invention, it includes a positioning assembly, generally 20. In particular, the positioning assembly 20 is structured to position the typically large slab of the solid material 5 in a cuttable orientation. As a result, the positioning assembly 20 preferably maintains a major portion or face of the solid material 5 exposed, and is configured such that it does not generally hinder or otherwise restrict the cutting process to be achieved while it supports or suspends the solid material 5 in the cuttable orientation. Although brackets and other structure could be employed, in the illustrated preferred embodiment, the positioning assembly 20 preferably includes a large grate 22 on which the solid material 5 sits. Naturally, as the cut passes through the solid material 5 it will eventually wear the grate 22 such that it requires replacement, however, such a preferred structure generally maintains the entire solid material 5 properly oriented and supported throughout the entire cut, even as certain pieces become completely cut from the larger slab or block.

In order to achieve the precision cut, the fluid jet cutting system 10 of the present invention further includes a fluid jet generator, generally 30. As illustrated, at least one fluid jet generator 30 is provided, however, in some circumstances a plurality of fluid jet generators 30, and/or nozzles 32 thereof may be provided from a single or multiple fluid sources so as to make multiple cuts and/or so as to further facilitate the formation of a single precision cut. Along these lines, and as indicated, the fluid jet generator includes at least one nozzle 32. The nozzle 32 is structured to focus and direct a high pressure stream of fluid 34 towards the solid material 5. Preferably the nozzle 32 is structured to accurately define a precision stream of fluid, as will be described. Also in the preferred embodiment, a high pressure fluid pump 38 is provided, the fluid typically being purified water and being pumped through a conduit 36 into the nozzle 32, such that the pressure generated by the pump 38, along with the specific configurations of the nozzle 32 generates the high pressure stream of fluid 34. Furthermore, in the preferred embodiment, an abrasive material, such as garnet is preferably mixed with the fluid prior to exiting the nozzle 32 so as further comprise the high pressure stream of fluid 34. A separate abrasive adding structure 39 is typically preferred such that the abrasive material can be added at the nozzle 32, or in very close proximity to the exit point of the high pressure stream 34. As can be appreciated, the force of the water/abrasive mixture under extreme pressure achieves the required definition and precision in the cut to be made.

The fluid jet cutting system 10 of the present invention further includes a guidance system, generally 40. In particular, the guidance system 40 is structured to move or pass the nozzle 32 over the solid material 5 in a predetermined cutting path while the high pressure stream of fluid 34 is emanating therefrom. As a result, a specific cut 6 in accordance with that cutting path is made within the solid material 5 by the high pressure stream 34. In the preferred, and illustrated embodiment, the guidance system preferably includes a series of pivots, tracks and rods which maneuver the nozzle 32, preferably disposed in close proximity to the solid material 5, over the solid material 5 in accordance with the predetermine cutting path such that as the high pressure stream of fluid 34 exit the nozzle 32 it impacts the solid material 5 at a particular desired location, passing through the solid material 5 and generating the desire cut. Further looking into the illustrated embodiment of the guidance system, in this preferred embodiment a pair of preferably parallel tracks 42 and 42' are disposed either a fixed or variable distance from one another, the distance preferably being greater than a corresponding dimension of the solid material 5 so as to achieve a full range of coverage possibilities when following the cutting path. Preferably suspended between the tracks 42 and 42' is an elongate rod 44 on which the nozzle 32 is secure. The rod 44 is preferably structured to move latterly within the tracks 42 and 42', such as by the incorporation of one or more wheels 43 and/or a servo motor 48 connected thereto. Furthermore, a nozzle holder 46 is also preferably disposed on the elongate rod 44. The nozzle holder 46, if desired can pivot the nozzle 32, thereby minimizing a range of movement that is actually required, and is also preferably structured to move along a length of the rod 44, also such as by a servo motor. As a result, utilizing a typical programmable computer control for the guidance system, the nozzle 32 can be positioned at virtually any given point over the solid material 5 following any desired pattern. Moreover, necessary shut off and continuance of the fluid stream, such as when breaks in the cut are required may also be achieved by the guidance systems controller. Of course, it should be understood that the particular guidance system 40 of the illustrated preferred embodiment is only one of many guidance systems that could be used, as it is possible for a single multi positional arm or other structure to be connected to the nozzle 32, and/or for one or more of the nozzles 32 to be included at generally fixed locations and pivoted and/or angled towards the solid material 5 so as to vary the cut merely by changing the angle and orientation of the nozzle 32. Still, however, a vertical positioning of the nozzle 32 directly above the solid material 5 and in close proximity thereto is preferred as a smoother vertical cut 6 is generated within the solid material 5. Also, if a plurality of the nozzles 32 are utilized, each nozzle can be dedicated to a specific portion of the cut, or can be utilized simultaneously so as to provide multiple cuts depending upon the capabilities and/or the maneuverability of the guidance system 40 and its controller.

Naturally, as the high pressure stream of fluid 34 generates the cut 6 within the solid material 5, it must eventually pass through the solid material 5. In this regard, the present invention further includes a fluid reservoir 50. The fluid reservoir 50 is disposed to receive the high pressure stream of fluid subsequent to its passage through the solid material 5. Accordingly, in the preferred embodiment wherein a vertical orientation of the nozzle 32 is provided, the solid material 5 is preferably suspended partially in or just above the fluid reservoir 50. As shown, the fluid reservoir 50 preferably includes an open interior 52 wherein a large volume of fluid 54 is contained. This volume of fluid is naturally increased as the high pressure stream of fluid 34 passes through and cuts the solid material 5. As a result, the fluid reservoir 50 may also include a drain 56 which in some instances can be connected to a fluid recycling structure so as to filter and pass the drained fluid back through the fluid pump 38 and back into the nozzle 32 to generate a continuous cycle of cutting without requiring the extensive use of large volumes of new fluid. Also, the fluid reservoir will over time collect the abrasive material, which is preferably not recycled along with the remaining fluid, and must therefore be emptied periodically.

The present invention as further recognizes that as the high pressure stream of fluid 34 passes through the solid material 5 and enters the fluid reservoir 50, and more particularly the volume of fluid 54 within the fluid reservoir 50 certain flow properties are generally exhibited. In particular, among other factors, an important characteristic associated with the various quality cuts previously discussed relates to the movement rate imparted on the nozzle 32 by the guidance system 40. Furthermore, the present invention recognizes that when a slower very high quality cut, such as a Q5 cut, is being made through the solid material 5, the high pressure stream 34 follows a generally straight path into the fluid reservoir, and a generally laminar fluid stream with generally laminar flow characteristics is maintained by the high pressure stream of fluid 34 entering the fluid reservoir 50. Conversely, as the movement rate is increased, the cutting rate through the solid material 5 is also increased, but the quality of the cut also in turn decreases, destabilizing the flow path of the high pressure stream 34. Specifically, and as illustrated in FIG. 2, as the high pressure stream of fluid 34 is moved more quickly through the solid material 5, the fluid stream tends to bend as it passes through the solid material. This bending effect, in addition to decreasing the quality of the cut also results in a more turbulent fluid stream entering the fluid reservoir 50. The more turbulent the fluid stream the more the bending and the greater a fish-tail effect of the fluid stream in the fluid reservoir. Having recognizing these divergent characteristics depending upon the quality of the cut, the fluid jet cutting system 10 of the present invention also includes a quality monitoring assembly, generally 60. The quality monitoring assembly 60, which can be partially or entirely integrated with the computer control of the guidance system 40 and/or fluid jet generator 30 is structured to monitor variations in the high pressure stream of fluid 34 that is entering the fluid reservoir. Moreover, the quality monitoring assembly 60 also preferably modifies a movement rate of the high pressure stream of fluid 34 in response to those monitored variations, thereby achieving a substantially consistent quality cut of the solid material 5 at all point through out the cutting path.

Based upon the previously described, recognized characteristics for the high pressure fluid stream 34 as it enters the fluid reservoir 50, a base line, optimal flow characteristics which define the desired optimum flow conditions for a particular quality type cut are preferably initially identified by or for the quality monitoring assembly 60 for comparison purposes. Furthermore, although the optimal movement rate for a particular quality cut may vary depending upon the material and or the curvature of the cut, in the preferred embodiment, the identified base line, optimal flow characteristics for a given desired quality will generally remain consistent, as this is detected after the cut has been made and the degree of bending is directly related to the quality. Of course, as to some materials and/or intricate cuts some modification in the base line may be exhibited, however, sampling of various materials and cuts will generally provide the necessary optimal conditions for virtually all different situations.

The base line, or optimal flow characteristics generally will be such that a preferably precision cut of the particular desired quality will be made and maintained through the solid material 5, however, the optimal flow characteristics will also enable a maximum movement rate that will achieve that desired quality cut to be maintained. For example, when using charts or employing manual monitoring or other control of a fluid jet, a certain degree of imprecision which does not take into account on going variables is typically exhibited, and it is usually only after a cut is completed or a length of cut is made that the actual product be examined in order to identify the true quality of the cut which was made. As a result, such manual and conventional cutting systems typically utilize a slower than required movement rates so as to ensure that at least the desired quality is achieved, especially when dealing with large quantities of expensive materials. In this regard, it is also necessary for an employee to be constantly available to monitor the cut and/or to detect disruptions in the cut, such as a failure of the fluid stream to penetrate the solid material due to a broken nozzle or other malfunction. Accordingly, known systems have significant limitations as to the rate at which they may cut while still making precision quality cuts, and indeed the time that is taken for the cuts is often much greater than is truly required. Further, known systems could not generally be left unattended, as sever malfunctions must be identified immediately by an operator to effectuate a shut off of the system. Conversely, the quality monitoring system 60 of the present invention by monitoring variations from the base line optimal flow characteristics required for a desired quality cut can accordingly adjust the movement rate of the fluid stream 34 in accordance to the monitored variations in a preferably automatic fashion. For example, upon the detection of the flow characteristics indicating flow characteristics that are more laminar than the base line optimal flow characteristics, the movement rate is increased by the quality monitoring assembly 60, thereby maximizing the high quality cutting rate that can be achieved without sacrificing the quality. Conversely, when the quality monitoring assembly 60 monitors and detects flow characteristics of the fluid stream which indicate a flow that is more turbulent than the base line optimal flow characteristics for the desired quality cut, the quality monitoring assembly 60 decreases the movement rate and thereby the needed quality of the cut is ensured without overly sacrificing the cutting rate. Indeed, this constant modification and adjustment can be substantially continuous so as to ensure that the optimal flow characteristics of the fluid stream are generally maintained, and therefore such that the optimal cutting properties, including cutting rate and cut quality are maintained. As indicated, utilizing the present system 10, the base line, optimal flow characteristics can be set for each degree of quality and if desired for each type of material, and can be set much closer to the limits required for the desired quality since over-compensation well into the high quality flow conditions is not required. Also, it is noted that for the purposes of the present invention, a movement rate adjustment can include a modification in the volume of water exiting the nozzle, such as by opening or closing the nozzle 32 and/or increasing the pump rate, or as preferred includes an adjustment in the rate at which the nozzle moves over the solid material 5.

Looking further to the monitoring of the flow conditions achieved by the quality monitoring assembly 60, as an added advantage if the detected flow characteristics are excessively turbulent, or if no flow is detected, the present system identifies that a very serious malfunction that cannot be compensated merely by adjusting the movement rate has occurred. In such a circumstance, the quality monitoring assembly 60 is structured to shut down all or part of the system until reset by an operator. Such a quality substantially facilitates a fully automated use of the present system, even when no operator is present, as malfunctions are automatically identified and addressed.

In the preferred embodiment, the quality monitoring assembly 60 includes one or more audio sensors 62 disposed in or on the fluid reservoir 50. The audio sensors 62 can be radio controlled or can be connected by one or more cables 63 as part of the quality monitoring assembly 60 and/or a sensor computer processor assembly that is integrated with or integrates the quality monitoring assembly 60 with the other the controllers required by the system's 10 components. The audio sensors 62 are preferably disposed within the fluid reservoir 50, although they could be secured to the interior or exterior walls of the reservoir 50, are preferably structured to detect modifications and variations in the flow characteristics of the fluid stream, those modifications and variations preferably relating to a volume and/or frequency characteristic of the high pressure stream. For example, a more turbulent flow will naturally have an increased volume and frequency, whereas a more laminar flow will have a decreased volume and frequency. By monitoring the volume and/or frequency characteristics of the high pressure stream 34 as it enters the fluid reservoir 50, the audio sensors are thereby able to identify and detect the variations in the flow characteristics from the base line, optimal flow characteristics. In turn, the monitored variations result in a corresponding modification to the movement rate by the quality monitoring assembly 60 such that a corresponding increase or decrease, depending upon a detected turbulent or laminar fluid stream, can be appropriately made in the high pressure fluid stream 34. In the preferred embodiment, the audio sensors 62 include submergible microphones, the submergible microphone preferably first being utilized to identify and detect the flow characteristics of what is determined by the system programmers to be optimal characteristic. For example, a stock or representative sample of a particular type of material can be utilized so as to make a cut, each section of the cut being correlated to certain audio characteristics detected by the audio sensor. Once the cut is completed, the segments of the precision cut can be monitored so as to identify the characteristics exhibited for a certain quality cut. At that point, the specific optimal flow characteristics are identified and can be stored if desired by the precision monitor assembly 60. In this regard, although a single optimal flow characteristic level may be utilized for a particular cut quality in a variety of different materials, it may be necessary for different parameters to be set, such as thickness and/or type of material, those parameters dictating the nature and characteristics of the optimal flow characteristics to be sought by the quality monitoring assembly 60. Further, it may be necessary to correlate a location of the nozzle 32 relative to the sensors 62, as this may also impact the manner in which the flow characteristics are perceived. Also, although an impact detector, visual sensor or other detector are also contemplated to identify flow characteristics with the quality monitoring assembly 60 of the present invention, the audio sensor is preferred as the fluid in the reservoir can become rather cloudy, and the abrasive material eventually fills the reservoir and would cover any underlying structure.

The present invention is further directed towards a method of making a precise quality cut in a solid material. Preferably, the method is achieved utilizing the fluid jet cutting system 10 of the present invention.

Looking particularly to the method, the preferred initial step includes a monitoring of optimal flow conditions which are exhibited during the performance of a particular desired quality cut through a sample of a solid material. Once this can be done, a section of the solid material which is to be cut is then positioned in a cuttable orientation in a fluid reservoir. An audio sensor is then disposed in operative proximity to the fluid reservoir so as to monitor the flow conditions. As a result, upon a high pressure stream being directed into the solid material so as to cut through the material, the flow conditions of the high pressure stream as it passes through the solid material and enters the fluid reservoir are monitored. In order to achieve a desired quality cut in the solid material, the high pressure stream of fluid is moved over the solid material in accordance with the desired cutting path and at a specified movement rate. Moreover, preferably throughout and simultaneous with the step of moving the high pressure stream of fluid along the desired cutting path, the flow conditions of the high pressure stream entering the fluid reservoir are monitored. Also, the flow conditions are preferably monitored by detecting a volume and/or frequency of the high pressure stream as the flow conditions.

Finally, a movement rate of the high pressure stream of fluid over the solid material is adjusted in response to the monitored flow conditions until the optimal flow conditions indicating a precision cut of a desired quality and at a maximum cutting rate are achieved. This step of adjusting the movement rate in response to the monitored flow conditions preferably includes increasing a movement rate when the monitored flow conditions indicate a flow more laminar than the optimal flow conditions, or a decreasing of the movement rate upon the monitored flow conditions indicating a flow more turbulent than the optimal flow conditions. Accordingly, a very precise and desired quality cut can be made, but the time which it takes to make that cut can be significantly reduced, and indeed in optimal circumstances 24 hour operation of the cutting system and full automation can also be achieved utilizing the fluid jet cutting system 10 and preferred method of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To make precision cuts in a solid material, a fluid jet cutting system comprising:

a positioning assembly structured to position the solid material in a cuttable orientation;

at least one fluid jet generator, said fluid jet generator including at least one nozzle and structured to direct a concentrated, high pressure stream of fluid through said nozzle;

said fluid jet generator further including a guidance system structured to pass said nozzle over the solid material in a predetermined cutting path such that said high pressure stream of fluid passing through said nozzle engages and cuts through the solid material in accordance with said cutting path;

a fluid reservoir disposed to receive said high pressure stream of fluid subsequent to passage thereof through the solid material; and a quality monitoring assembly, said quality monitoring assembly structured to monitor variations in said high pressure stream of fluid entering said fluid reservoir and to modify a movement rate of said nozzle, and accordingly said high pressure stream of fluid, along said cutting path, in response to said variations in said high pressure stream of fluid entering said fluid reservoir, so as to achieve a substantially consistent quality cut of the solid material at a maximum movement rate of said high pressure stream of fluid.

2. A fluid jet cutting system as recited in claim 1 wherein said quality monitoring assembly monitors flow characteristics of said high pressure stream of fluid entering said fluid reservoir, said variations comprising variations from a base line, optimal flow characteristic for a desired quality cut.

3. A fluid jet cutting system as recited in claim 2 wherein said quality monitoring assembly is structured to shut down said fluid jet generator upon detecting flow characteristics outside of acceptable parameters.

4. A fluid jet cutting system as recited in claim 2 wherein said quality monitoring assembly includes an audio sensor disposed in said fluid reservoir.

5. A fluid jet cutting system as recited in claim 4 wherein said quality monitoring assembly is structured to automatically adjust a movement rate of said fluid stream such that said flow characteristics detected by said audio sensor are generally maintained at said base line, optimal flow characteristics.

6. A fluid jet cutting system as recited in claim 4 wherein said flow characteristics detected by said audio sensor include volume and frequency characteristics of said high pressure stream.

7. A fluid jet cutting system as recited in claim 1 wherein said quality monitoring assembly includes an audio sensor disposed in said fluid reservoir.

8. A fluid jet cutting system as recited in claim 7 wherein said audio sensor detects said variations between an increasingly laminar to an increasingly turbulent fluid stream, said turbulent fluid stream indicating a faster, lower quality cut being made, and said laminar fluid stream indicating a slower, higher quality cut being made.

9. A fluid jet cutting system as recited in claim 8 wherein said quality monitoring assembly is structured to increase a movement rate of said fluid stream upon detection of said flow characteristics indicating said fluid stream is laminar below a base line, optimal flow characteristics for a desired quality cut, thereby maximizing a cutting rate to be achieved without sacrificing said desired quality cut.

10. A fluid jet cutting system as recited in claim 9 wherein said quality monitoring assembly is structured to decrease of said fluid stream upon detection of said flow characteristics indicating said fluid stream is turbulent above said base line, optimal flow characteristics for said desired quality cut, thereby ensuring said desired quality cut is achieved without sacrificing the cutting rate.

11. A fluid jet cutting system as recited in claim 7 wherein said audio sensor comprises at least one submersible microphone disposed in said reservoir.

12. A fluid jet cutting system as recited in claim 1 wherein said quality monitoring assembly is structured to identify a cutting malfunction which prevents said high pressure stream of fluid from entering said fluid reservoir and to shut down said fluid jet generator.

13. A method of making a precision cut in a solid material, said method comprising the steps of:

positioning the solid material in a cuttable orientation over a fluid reservoir;

directing a high pressure stream of fluid into the solid material so as to cut through the material;

moving said high pressure stream of fluid along a cutting path at a predetermined movement rate;

monitoring flow conditions of the high pressure stream as it passes through the solid material and enters the fluid reservoir; and adjusting said movement rate of the high pressure stream in response to said monitored flow conditions until optimal flow conditions indicating a desired quality cut and maximum movement rate are achieved.

14. A method as recited in claim 13 wherein said step of monitoring said flow conditions further comprises disposing an audio sensor in operative proximity to the fluid reservoir.

15. A method as recited in claim 14 further comprising the step of detecting a volume and frequency of the high pressure stream as it enters the fluid reservoir as said flow conditions.

16. A method as recited in claim 13 further comprising an initial step of monitoring the optimal flow conditions which are exhibited during the performance of an desired quality cut through a sample of the solid material.

* * * * *